US010786993B2

(12) United States Patent
Inoue

(10) Patent No.: US 10,786,993 B2
(45) Date of Patent: Sep. 29, 2020

(54) LIQUID EJECTING APPARATUS

(71) Applicant: SEIKO EPSON CORPORATION, Tokyo (JP)

(72) Inventor: Ryo Inoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/358,521

(22) Filed: Mar. 19, 2019

(65) Prior Publication Data

US 2019/0291439 A1 Sep. 26, 2019

(30) Foreign Application Priority Data

Mar. 20, 2018 (JP) ..... 2018-052139

(51) Int. Cl.
*B41J 2/165* (2006.01)

(52) U.S. Cl.
CPC ..... *B41J 2/1652* (2013.01); *B41J 2/16508* (2013.01)

(58) Field of Classification Search
CPC .. B41J 2/1652; B41J 2/16508; B41J 2/16532; B41J 2/16523
See application file for complete search history.

(56) References Cited

U.S. PATENT DOCUMENTS 5,850,239 A * 12/1998 Gentile ..... B41J 2/1652 347/30
2010/0103217 A1 4/2010 Takase
2017/0151805 A1* 6/2017 Sato ..... B41J 2/16526

FOREIGN PATENT DOCUMENTS

JP 2010-131982 A 6/2010
JP 2012-035424 A 2/2012

* cited by examiner

*Primary Examiner* — Sharon A. Polk
(74) *Attorney, Agent, or Firm* — Workman Nydegger

(57) ABSTRACT

There is provided a liquid ejecting apparatus including: a liquid-ejecting-portion configured to eject a liquid from a nozzle; a cap configured to be relatively move with respect to the liquid-ejecting-portion and configured to form a closed space in which the nozzle is open between the cap and the liquid-ejecting-portion; a negative-pressure-generation-mechanism configured to generate a negative pressure; a pressure chamber configured to accumulate the negative pressure by driving the negative-pressure-generation-mechanism; a discharge flow path that communicates with the cap and the pressure chamber; a discharge flow path opening/closing mechanism configured to open and close the discharge flow path; a volume variable mechanism configured to change a volume of the pressure chamber; and a controller that controls the negative-pressure generation-mechanism, the discharge flow path opening/closing mechanism, and the volume variable mechanism.

13 Claims, 4 Drawing Sheets

LIQUID EJECTING APPARATUS

BACKGROUND

1. Technical Field

The present invention relates to a liquid ejecting apparatus including a liquid ejecting portion capable of ejecting a liquid from a nozzle.

2. Related Art

In the related art, there is known a liquid ejecting apparatus including a liquid ejecting portion having a nozzle capable of ejecting a liquid and a cap capable of forming a closed space in which the nozzle of the liquid ejecting portion is opened by bringing the cap into contact with the liquid ejecting portion. In such a liquid ejecting apparatus, a negative pressure generated by a negative pressure generator such as a tube pump is accumulated in a pressure chamber of a constant volume, and the accumulated negative pressure is applied to the closed space formed between the cap and the liquid ejecting portion so as to perform cleaning of discharging a liquid from the liquid ejecting portion to an outside via the nozzle (for example, refer to JP-A-2012-35424).

However, when the volume of the pressure chamber that accumulates the negative pressure is constant as in the above liquid ejecting apparatus, it is not possible to change the magnitude of the negative pressure which is applied to the closed space when executing a cleaning.

SUMMARY

An advantage of some aspects of the invention is to provide a liquid ejecting apparatus capable of executing a cleaning in which the magnitude of a negative pressure applied on a closed space is different.

According to an aspect of the invention, there is provided a liquid ejecting apparatus including: a liquid ejecting portion configured to eject a liquid from a nozzle; a cap configured to be relatively move with respect to the liquid ejecting portion and configured to form a closed space in which the nozzle is open between the cap and the liquid ejecting portion; a negative pressure generation mechanism configured to generate a negative pressure; a pressure chamber configured to accumulate the negative pressure by driving the negative pressure generation mechanism; a discharge flow path that communicates with the cap and the pressure chamber; a discharge flow path opening/closing mechanism configured to open and close the discharge flow path; a volume variable mechanism configured to change a volume of the pressure chamber; and a controller that controls the negative pressure generation mechanism, the discharge flow path opening/closing mechanism, and the volume variable mechanism.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a liquid ejecting apparatus according to a first embodiment will be described with reference to the drawings.

Figure 1:
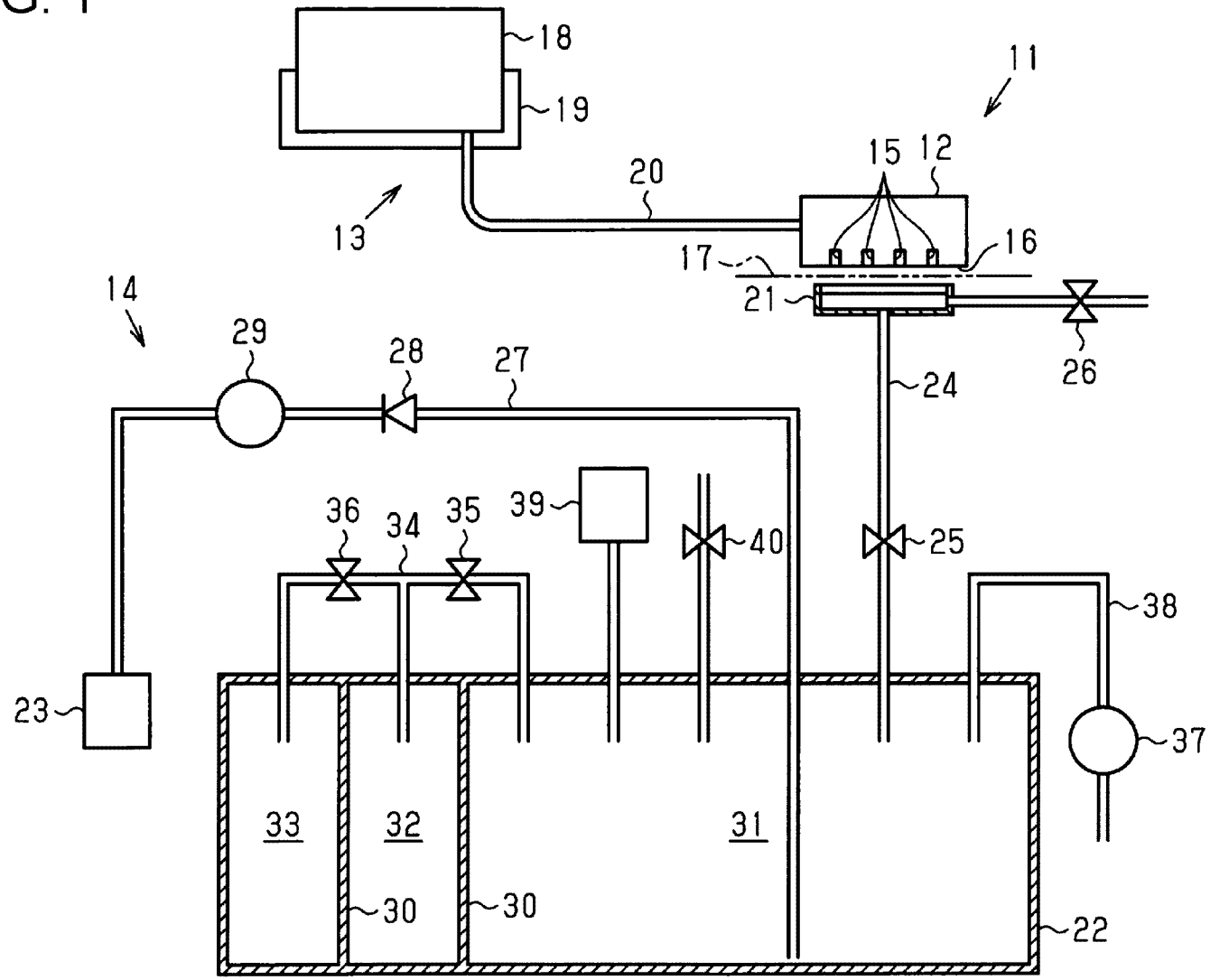
FIG. 1 is a schematic diagram schematically showing an overall configuration of a liquid ejecting apparatus according to a first embodiment.

As shown in FIG. 1, the liquid ejecting apparatus 11 of the present embodiment includes a liquid ejecting portion 12 that ejects a liquid, a liquid supply unit 13 that supplies the liquid to the liquid ejecting portion 12, and a maintenance device 14 for performing maintenance of the liquid ejecting portion 12. The liquid ejecting portion 12 has an opening surface 16 in which one or a plurality of nozzles 15 is opened, and is configured so that a liquid such as ink can be ejected from the nozzle 15 to a medium 17 such as a paper.

The liquid supply unit 13 includes a liquid storage portion 18 which is a container in which the liquid to be supplied to the liquid ejecting portion 12 is contained, a holder portion 19 which makes the liquid storage portion 18 attachable/detachable, and a supply flow path 20 disposed so as to supply the liquid from the liquid storage portion 18 attached to the holder portion 19 to the liquid ejecting portion 12. In the liquid storage portion 18, for example, a plurality of liquid storage portions 18 corresponding to each of a plurality of colors of liquid is attached to the holder portion 19 in an attachable/detachable manner. The supply flow path 20 is configured with a plurality of flexible tubes or the like corresponding to each of the plurality of liquid storage portions 18. The liquid storage portion 18 may be, for example, a cartridge attached to the liquid ejecting apparatus 11 in an attachable/detachable manner, or a tank that can supply liquid by filling.

The maintenance device 14 includes a cap 21, a container 22 having a space inside, and a waste liquid storage portion 23. The cap 21 is provided so as to be relatively movable with respect to the liquid ejecting portion 12. That is as shown in FIG. 1, the cap 21 is movable in a vertical direction between a separated position that is separated downward from the liquid ejecting portion 12 and a contact position that contacts the opening surface 16 which is a lower surface of the liquid ejecting portion 12 so as to surround the nozzle 15 by an elevating mechanism (not shown). When the cap 21 moves to the contact position and comes into contact with the liquid ejecting portion 12, a closed space, in which the nozzle 15 is open to a space between the cap 21 and the liquid ejecting portion 12, can be formed.

Between the cap 21 and the container 22, a discharge flow path 24 configured with a tube or the like that allows the inside of the cap 21 and the inside of the container 22 communicate with each other, is disposed. When the cap 21 moves to the contact position to form the closed space between the cap 21 and the liquid ejecting portion 12, the discharge flow path 24 allows the closed space and the upstream end of the discharge flow path 24 communicate with each other. A pressure opening/closing valve 25, which is an example of a discharge flow path opening/closing mechanism capable of opening/closing the discharge flow path 24, is provided in the middle of the discharge flow path 24. The cap 21 is provided with an atmosphere opening valve 26 capable of opening the closed space in the cap 21 to the atmosphere in a state where the closed space is formed between the cap 21 and the liquid ejecting portion 12.

Between the container 22 and the waste liquid storage portion 23, a recovery flow path 27 configured with a tube or the like that allows the inside of the container 22 and the inside of the waste liquid storage portion 23 communicate each other, is disposed. A check valve 28, which is a one way valve that allows the flow of a liquid to a downstream which is on the side of the waste liquid storage portion 23 from the position of the check valve 28 while the flow of a liquid to an upstream which is on the side of the container 22 from the position of the check valve 28 is suppressed, is provided in the middle of the recovery flow path 27. In the recovery flow path 27, a suction pump 29 such as a tube pump or the like is provided at a position between the check valve 28 and the waste liquid storage portion 23.

As shown in FIG. 1, a space inside the container 22 is partitioned into a plurality (three in the present embodiment) of chambers 31, 32 and 33 which constitute the pressure chamber by at least one partition wall 30 (two in the present embodiment). Among the plurality of chambers 31, 32 and 33, the downstream end of the discharge flow path 24 and the upstream end of the recovery flow path 27 are connected to a first chamber 31 having the largest volume and positioned at the right end in FIG. 1. In the container 22, a second chamber 32 and a third chamber 33 partitioned as a chamber different from the first chamber 31 by the partition wall 30 are configured to have the same volume and the total volume thereof is smaller than that of the first chamber 31.

In the container 22, a space between the first chamber 31 and the second chamber 32, a space between the first chamber 31 and the third chamber 33, and a space between the second chamber 32 and the third chamber 33 are connected by a communication flow path 34 configured with a tube or the like. In the communication flow path 34, a first flow path opening/closing valve 35 is provided in the middle of a part of the flow path connecting the first chamber 31 and the second chamber 32, and the first chamber 31 and the third chamber 33. The first flow path opening/closing valve 35 is an example of a communication flow path opening/closing mechanism capable of opening/closing the part of the flow path. In the communication flow path 34, a second flow path opening/closing valve 36 is provided in the middle of a part of the flow path connecting the third chamber 33 and the second chamber 32, and the third chamber 33 and the first chamber 31. The second flow path opening/closing valve 36 is an example of a communication flow path opening/closing mechanism capable of opening/closing the part of the flow path.

A negative pressure generation mechanism 37 configured with a diaphragm pump or the like is connected to the first chamber 31 via a suction flow path 38. When the pressure opening/closing valve 25 of the discharge flow path 24 is a closed state, the first chamber 31 is in a state of being isolated from the outside. Therefore, when the negative pressure generation mechanism 37 is driven in the state of being isolated from the outside, negative pressure is accumulated inside the first chamber 31. Note that, although not shown, in the suction flow path 38, it is preferable to provide an opening/closing valve capable of opening/closing the suction flow path 38 in a part of the flow path which is on the side of the first chamber 31 from the negative pressure generation mechanism 37, and open the opening/closing valve in a case where the negative pressure generation mechanism 37 is driven to accumulate the negative pressure to the first chamber 31 and close the opening/closing valve in a case where the accumulated negative pressure is applied to perform a cleaning. As shown in FIG. 1, the container 22 is provided with a pressure sensor 39 capable of detecting the magnitude of the pressure in the first chamber 31 and a release valve 40 capable of communicating the first chamber 31 with the atmosphere by opening the release valve 40.

Next, the electrical configuration of the liquid ejecting apparatus 11 will be described.

Figure 2:
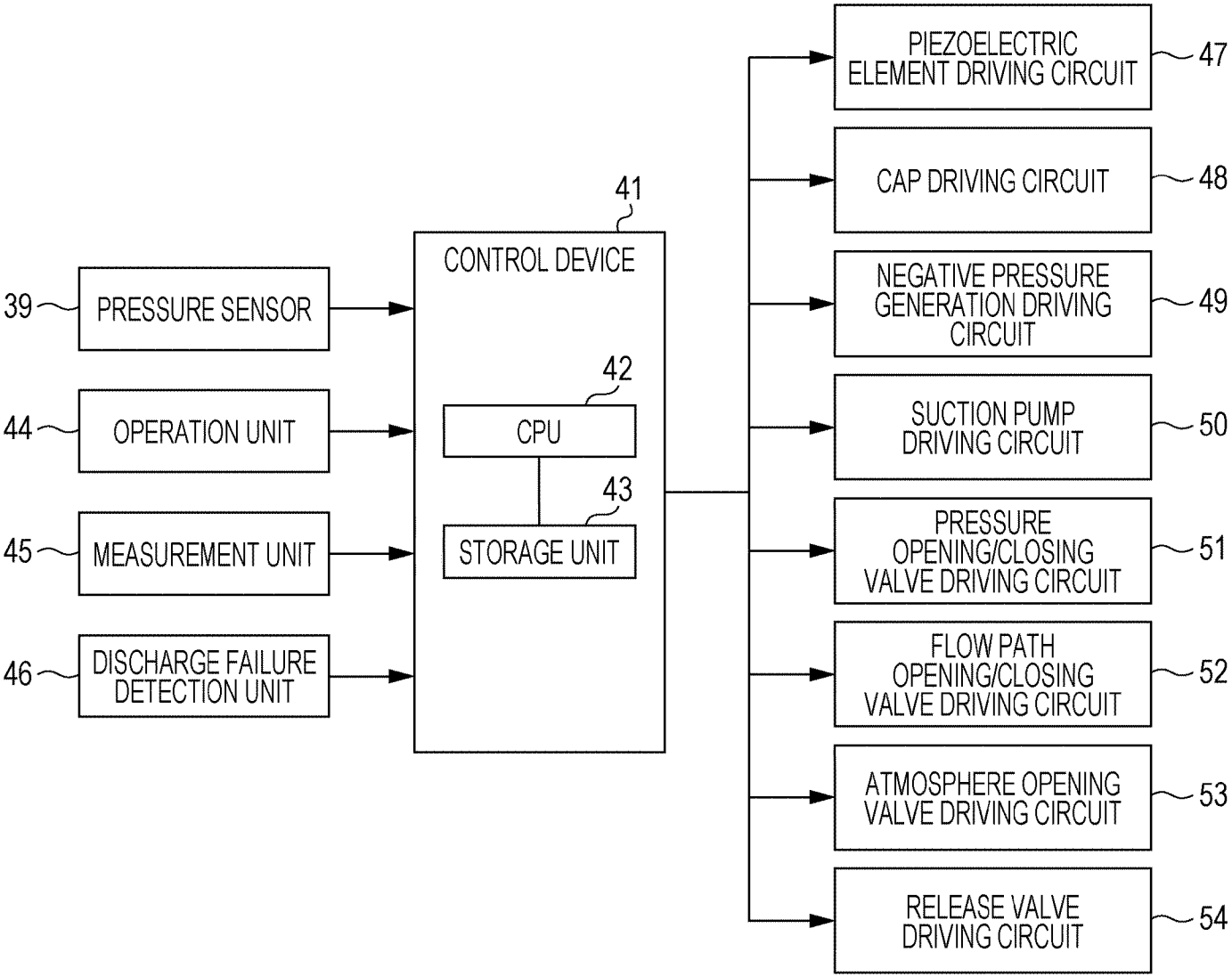
FIG. 2 is a block diagram of a control configuration in the liquid ejecting apparatus.

As shown in FIG. 2, the liquid ejecting apparatus 11 includes a control device 41 configured with a microprocessor or the like as an example of a controller. The control device 41 includes a CPU 42 as a central processing device that performs overall control of the liquid ejecting apparatus 11 and a storage unit 43 configured with a nonvolatile memory or the like for storing a program or the like performed by the CPU 42 at the time of the maintenance of the liquid ejecting portion 12 by the maintenance device 14 or the like. In addition to the above-described pressure sensor 39, an operation unit 44, a measurement unit 45, and a discharge failure detection unit 46 are connected to the input side interface (not shown) of the control device 41.

The pressure sensor 39 periodically detects the pressure in the first chamber 31 and transmits a detection signal indicating the detection result to the control device 41. The operation unit 44 is configured with a touch panel or the like provided on an upper part of a front surface of a housing (not shown) which contains various mechanisms such as the liquid ejecting portion 12 inside in the liquid ejecting apparatus 11. On the surface of the operation unit 44, in addition to displaying an operational state of the liquid ejecting apparatus 11, a power button or various operation buttons operated by a user or the like are displayed. As the operation buttons, there are a cleaning command button or the like to which an operation command is inputted by a user, for example, when executing a cleaning which is one of the maintenance operations of the liquid ejecting portion 12.

Note that, the cleaning is a maintenance operation for discharging foreign materials such as air bubbles contained in the liquid inside the liquid ejecting portion 12 or inside the supply flow path 20 by forcibly discharging the liquid from the nozzle 15 of the liquid ejecting portion 12. Cleaning is roughly classified into a pressurized cleaning and a suction cleaning depending on a difference in a method of applying pressure to the nozzle 15 of the liquid ejecting portion 12. The pressurized cleaning is a cleaning where a positive pressure is applied to a liquid, which is on the upstream side from the nozzle 15 in the liquid ejecting portion 12, from the upstream side of the supply flow path 20 toward the nozzle 15 on the downstream side to discharge the liquid from the nozzle 15.

On the other hand, the suction cleaning is a cleaning where a negative pressure accumulated in the pressure chamber which has a predetermined volume including the first chamber 31 is applied to the closed space formed by the cap 21 contacting the liquid ejecting portion 12 based on the driving of the suction pump 29 or the negative pressure generation mechanism 37, and the liquid is discharged from the nozzle 15 which opens into the closed space. In the present embodiment, the maintenance device 14 performs the suction cleaning instead of the pressurized cleaning.

The measurement unit 45 is configured with a counting circuit which counts pulse signals outputted at a constant period, for example, and outputs the count value as measurement signals. In the present embodiment, in the maintenance device 14, the measurement unit 45 transmits a measurement signal indicating an elapsed time from the execution of the previous cleaning to the control device 41. The control device 41 determines whether or not the elapsed time from the execution of the previous cleaning exceeds a predetermined time based on the measurement signal transmitted from the measurement unit 45. Note that, the predetermined time can be set any.

The discharge failure detection unit 46 is configured with a detection circuit for detecting residual vibration of a cavity (not shown) temporarily storing a liquid for discharging from the nozzle 15 inside the liquid ejecting portion 12, for example. That is when the liquid is ejected from the nozzle 15 of the liquid ejecting portion 12 at the time of printing or the like, a piezoelectric element (not shown) provided in the cavity corresponding to each nozzle 15 is driven. And the nozzle 15 having a discharge failure is detected by detecting the residual vibration after vibrating the inside of the cavity by the driving of the piezoelectric element with the piezoelectric element.

For example, as the viscosity of the liquid in the cavity increases, the residual vibration tends to attenuate and the cycle of the residual vibration becomes shorter. On the other hand, if air bubbles are mixed in the cavity, the residual vibration hardly attenuates and the period of the residual vibration becomes longer. When the cycle of the residual vibration in the cavity detected by the piezoelectric element becomes shorter than a predetermined lower limit cycle or becomes longer than a predetermined upper limit cycle, the discharge failure detection unit 46 detects the nozzle 15 corresponding to the cavity and the piezoelectric element as an nozzle 15 having a discharge failure and transmits detection signals indicating the detection result to the control device 41.

As shown in FIG. 2, a plurality kinds of drive circuits is connected to the output side interface (not shown) of the control device 41. The piezoelectric element driving circuit 47 drives the piezoelectric element provided in the cavity of the liquid ejecting portion 12 to eject the liquid from the nozzle 15 corresponding to the piezoelectric element. As described above, the piezoelectric element driving circuit 47 also drives the piezoelectric element when detecting the residual vibration of the cavity of the liquid ejecting portion 12 in order to detect the nozzle 15 having a discharge failure. The cap driving circuit 48 drives an elevating mechanism (not shown) that makes the cap 21 vertically move between the contact position and the separated position in order to relatively move the cap 21 with respect to the liquid ejecting portion 12. The negative pressure generation mechanism driving circuit 49 drives the negative pressure generation mechanism 37 configured with a diaphragm pump or the like when setting the pressure chamber in the container 22 including at least the first chamber 31 to a negative pressure.

The suction pump driving circuit 50 drives the suction pump 29 configured with a tube pump or the like when sucking the liquid which becomes a waste liquid from the pressure chamber of the container 22 including at least the first chamber 31 and causing the waste liquid storage portion 23 to recover the liquid. The pressure opening/closing valve driving circuit 51 drives the pressure opening/closing valve 25 so as to open or close the valve which is in the middle of the discharge flow path 24 when a state between the cap 21 and the first chamber 31, which are connected to each other via the discharge flow path 24, is switched between the communication state and the isolated state.

The flow path opening/closing valve driving circuit 52 drives at least one of the first flow path opening/closing valve 35 and the second flow path opening/closing valve 36 provided in the communication flow path 34. When both of the first flow path opening/closing valve 35 and the second flow path opening/closing valve 36 are opened, the volume of the pressure chamber which becomes a state of communicating with the cap 21 via the discharge flow path 24 is the sum of the volumes of the three chambers of the first chamber 31, the second chamber 32, and the third chamber 33. When the first flow path opening/closing valve 35 is opened and the second flow path opening/closing valve 36 is closed, the volume of the pressure chamber which becomes a state of communicating with the cap 21 via the discharge flow path 24 is the sum of the volumes of the two chambers of the first chamber 31, and the second chamber 32. Regardless of the opening/closing state of the second flow path opening/closing valve 36, when the first flow path opening/closing valve 35 is closed, the volume of the pressure chamber which becomes a state of communicating with the cap 21 via the discharge flow path 24 is only the volume of one chamber which is the first chamber 31.

Further, in a case where the atmosphere opening valve driving circuit 53 is in a state in which the closed space is formed between the cap 21 and the liquid ejecting portion 12 at the contact position where the cap 21 is in contact with the liquid ejecting portion 12, the atmosphere opening valve driving circuit 53 opens the atmosphere opening valve 26 when opening the closed space to the atmosphere. Then, the release valve driving circuit 54 opens the release valve 40 when the interior of the first chamber 31 communicates with the atmosphere. Each of the driving circuits described above drives each corresponding driving target based on control signals appropriately transmitted from the control device 41.

Next, the action of the liquid ejecting apparatus 11 configured as described above will be described focusing on the action in a case where the maintenance device 14 performs a suction cleaning, which is one of the maintenance operations for the liquid ejecting portion 12.

When the suction cleaning is to be performed in the liquid ejecting apparatus 11, first, the elevating mechanism of the cap 21 is driven by the cap driving circuit 48. Then, the cap 21 ascends from the separated position separated downward from the liquid ejecting portion 12 to the contact position in contact with the upward of the liquid ejecting portion 12, and a closed space, in which the nozzle 15 is open to a space between the opening surface 16 of the liquid ejecting portion 12 and the inner surface of the cap 21, is formed. In this case, it is assumed that the atmosphere opening valve 26 of the cap 21, the release valve 40 of the first chamber 31, the first flow path opening/closing valve 35 and the second flow path opening/closing valve 36 of the communication flow path 34 are in a closed state respectively.

Then, from this state, the pressure opening/closing valve 25 of the discharge flow path 24 is set in a closed state by the pressure opening/closing valve driving circuit 51, subsequently, the negative pressure generation mechanism 37 is driven in a state in which the opening/closing valve of the suction flow path 38 is opened by the negative pressure generation mechanism driving circuit 49. Then, as the negative pressure generation mechanism 37 is driven, a negative pressure is accumulated in the first chamber 31. When it is determined that a value of the negative pressure accumulated in the first chamber 31 reaches a preset threshold value at a normal time based on detection signals from the pressure sensor 39, the driving of the negative pressure generation mechanism 37 is stopped by the negative pressure generation mechanism driving circuit 49 and the opening/closing valve of the suction flow path 38 is closed.

When accumulating the negative pressure in the first chamber 31, the suction pump 29 may be driven by a suction pump driving circuit 50 instead of the negative pressure generation mechanism 37 or together with the negative pressure generation mechanism 37. In this case, the suction pump 29 functions as a negative pressure generation mechanism. In a case where the suction pump 29 is driven together with the negative pressure generation mechanism 37, since the negative pressure can be accumulated in the first chamber 31 in a shorter time than when only the negative pressure generation mechanism 37 is driven, it can contribute to improvement in cleaning efficiency.

Next, from this state, the pressure opening/closing valve 25 of the discharge flow path 24 is opened by the pressure opening/closing valve driving circuit 51. Then, the negative pressure accumulated in the first chamber 31 is applied to the closed space between the cap 21 and the liquid ejecting portion 12 via the discharge flow path 24. As a result, a suction cleaning, in which the liquid is discharged from the nozzle 15 of the liquid ejecting portion 12 by the negative pressure, is performed. That is a liquid is discharged from the nozzle 15 of the liquid ejecting portion 12 to the closed space with the suction force by the negative pressure, and the discharged liquid passes through the discharge flow path 24 and is temporarily storage stored in the first chamber 31.

Next, from this state, the suction pump 29 of the recovery flow path 27 is driven by the suction pump driving circuit 50, in a state in which the pressure opening/closing valve 25 of the discharge flow path 24 is closed again by the pressure opening/closing valve driving circuit 51 and also in a state in which the release valve 40 is by the release valve driving circuit 54. Then, the liquid temporarily storage stored in the first chamber 31 is sucked into the recovery flow path 27 by the suction pump 29, and then recovered in the waste liquid storage portion 23 at the downstream end of the recovery flow path 27. The cleaning performed by applying the negative pressure accumulated in the first chamber 31 to the closed space as described above is hereinafter referred to as a normal cleaning.

Generally, the cleaning operation is performed in order to suppress introducing a printing failure due to clogging of the nozzle 15 or the like when foreign materials such as air bubbles or dust are mixed in the liquid on the upstream side of the nozzle 15 of the liquid ejecting portion 12 to be cleaned and when a liquid is thickened, dried, and solidified in the liquid ejecting portion 12. However, depending on the thickening degree, the drying condition, and the mixing condition of air bubbles and foreign materials, there is a possibility that clogging of the nozzle 15 or the like can not be removed by performing the normal cleaning only once.

In such a case, it may be possible to repeat the same normal cleaning twice, three times, but then it takes too much time for cleaning. Therefore, in such a case, a so-called intensive cleaning is performed in which the magnitude of the negative pressure applied to the closed space is larger than the normal cleaning.

When the volume of the pressure chamber in which a negative pressure is accumulated is V, a pressure in the pressure chamber is P, the volume of the closed space is V', the volume of a total space of the pressure chamber and the closed space is (V+V'), and a pressure in the total space is P', the magnitude of a negative pressure applied to the closed space in which the nozzle 15 is open as the pressure opening/closing valve 25 is opened after the negative pressure is accumulated in the pressure chamber at the time of cleaning, is expressed by the following expressions. Note that, the volume of a part of the flow path such as the discharge flow path 24 is smaller than the volume of the pressure chamber or the closed space, and has little influence on the magnitude of the negative pressure applied to the closed space. Therefore, for convenience, the volume of the part of the flow path is ignored.

The magnitude of the negative pressure accumulated in the pressure chamber is shown on the left side and the magnitude of the negative pressure applied to the closed space after opening the pressure opening/closing valve 25 is shown on the right side, then the expression $PV=P'(V+V')$ is established, which can be converted to the expression $P'=PV/(V+V')$. From the converted expression, it can be seen that the larger the volume V of the pressure chamber in which the negative pressure is accumulated, the larger the negative pressure applied to the nozzle 15 in the closed space when cleaning.

In other words, in suction cleaning, it can be assumed that the magnitude of the negative pressure applied to the closed space is determined by the volume of the pressure chamber in which the negative pressure is accumulated. Therefore, in the liquid ejecting apparatus 11 of the present embodiment, in a case where the suction cleaning is performed for the liquid ejecting portion 12, the volume of the pressure chamber in which the negative pressure is accumulated is increased by the driving of the negative pressure generation mechanism 37 when executing an intense cleaning in which the magnitude of the negative pressure applied to the closed space is larger than that of the normal cleaning. In addition, it is possible to increase the amount of liquid discharged by performing the intensive cleaning.

The normal cleaning is used at the time of cleaning which is called a manual cleaning in which the cleaning is performed when a user arbitrarily presses a cleaning command button of the operation unit 44, in addition to cleaning which is called a periodic cleaning in which the cleaning is performed periodically at a preset cycle based on the control of the control device 41. The manual cleaning is performed by a user to press the cleaning command button of the operation unit 44 in a case where the user visually recognizes display content indicating that there is a discharge failure in the nozzle 15 on the display screen of the operation unit 44 based on the detection result of the discharge failure detection unit 46, in addition to a case where the user actually visually recognizes and determines that there is a printing failure in a printed image on the printed medium 17.

Suppose that the user watches the displayed content of the operation unit 44 indicating that there is a printing failure on the printed medium 17 or a discharge failure in the nozzle 15 and presses the cleaning command button of the operation unit 44 in order to perform the manual cleaning. In this case, normally, the above-described normal cleaning is performed and in a case described below, the above-described intensive cleaning is performed.

First, in a case where the control device 41 determines that an elapsed time since the previous cleaning, which is one time before this time, has exceeded the preset predetermined time based on the measurement signals from the measurement unit 45, the intensive cleaning is performed instead of normal cleaning since there is a high possibility that the liquid is thickened or solidified due to drying. That is in this case, at least the first flow path opening/closing valve 35 of the first flow path opening/closing valve 35 and the second flow path opening/closing valve 36 is opened by the flow path opening/closing valve driving circuit 52, at least the second chamber 32 of the second chamber 32 and the third chamber 33 communicates with the first chamber 31.

Then, the volume of the pressure chamber in which the negative pressure is accumulated as the negative pressure generation mechanism 37 is driven becomes a total volume in which the volume of the first chamber 31 and the volume of at least the second chamber 32 of the second chamber 32 and the third chamber 33 are summed. Accordingly, the volume of the pressure chamber is larger than the single volume of only the first chamber 31 when executing the normal cleaning. As a result, by applying a negative pressure accumulated in a large volume of the pressure chamber in which the plurality of chambers communicate and the volume is increased, to the closed space between the cap 21 and the liquid ejecting portion 12, the intensive cleaning is performed.

In the present embodiment, as described above, the flow path opening/closing valve driving circuit 52 opens at least the first flow path opening/closing valve 35 of the first flow path opening/closing valve 35 and the second flow path opening/closing valve 36 provided in the communication flow path 34 to increase the volume of the pressure chamber in which the negative pressure is accumulated. In this respect, in the present embodiment, the volume variable mechanism that is capable of changing the volume of the pressure chamber in which the negative pressure is accumulated is configured to include the communication flow path 34, at least one of the first flow path opening/closing valve 35 and the second flow path opening/closing valve 36, and the flow path opening/closing valve driving circuit 52.

Note that, in a case where the manual cleaning is performed by user's operation, even if it can be determined that the elapsed time from the previous cleaning has not exceeded the predetermined time based on the measurement signals from the measurement unit 45, the intensive cleaning is performed instead of normal cleaning in the following cases. That is in a case of manual cleaning by a user pressing the cleaning command button in the previous time and this time and when the number of times of cleaning performed by the operation command by the user within the predetermined time is larger than the predetermined number of times previously set, it is determined that clogging or the like of the nozzle 15 can not be eliminated by the magnitude of the negative pressure that accumulates the negative pressure in a single volume chamber of only the first chamber 31 and applied to the closed space as in the previous normal cleaning, therefore, as described above, the intensive cleaning where the volume of the pressure chamber in which the negative pressure is accumulated is large, is performed. Note that, the predetermined number of times of cleaning performed by an operation command by the user within the preset predetermined time can be arbitrarily set.

Next, in a case where it is determined that there is a nozzle 15 having a discharge failure by the detection result of the discharge failure detection unit 46, the normal cleaning is performed when the number of the nozzles 15 having a discharge failure is equal to or less than the preset predetermined number, and the intensive cleaning is performed when the number of the nozzles 15 having a discharge failure is larger than the preset predetermined number. It is desirable that the negative pressure applied to the ejection ports 15 having such discharge failure is larger in the case where the number of the ejection ports 15 having a discharge failure is larger than the predetermined number as compared with the case where the ejection number of the nozzles 15 having a discharge failure is equal to or less than the predetermined number, therefore, as described above, the intensive cleaning where the volume of the pressure chamber in which the negative pressure is accumulated is large, is performed. A cleaning based on the detection result of the nozzle 15 having a discharge failure by the discharge failure detection unit 46 may be a cleaning which is automatically performed under the control of the control device 41 based on the detection signals from the discharge failure detection unit 46, in addition to the manual cleaning by a user who checked such detection result. Note that, the preset predetermined number of the nozzles having a discharge failure can be arbitrarily set.

In a case where it is again detected that a nozzle 15 having a discharge failure still exists by the discharge failure detection unit 46 after executing the intense cleaning due to the fact that the number of the nozzles 15 having such discharge failure is larger than the predetermined number, the intensive cleaning in which the negative pressure that is even larger than the previous intensive cleaning is applied to the closed space is performed. For example, in a case where only the second chamber 32 is communicated with the first chamber 31 at the previous intensive cleaning, the flow path opening/closing valve driving circuit 52 opens the second flow path opening/closing valve 36 in addition to the first flow path opening/closing valve 35 and not only the second chamber 32 but also the third chamber 33 is communicated with the first chamber 31.

Then, the volume of the pressure chamber in which the negative pressure is accumulated as the negative pressure generation mechanism 37 is driven becomes an even larger total volume in which the volume of the first chamber 31, the volume of the second chamber 32, and the volume of the third chamber 33 are summed. As a result, as more chambers communicate with each other than the previous intensive cleaning, the negative pressure is accumulated in a large volume of the pressure chamber in which the volume is increased, and it is possible to discharge the liquid from the nozzle 15 which still has a discharge failure by applying the negative pressure larger than the previous cleaning to the closed space between the cap 21 and the liquid ejecting portion 12.

Even when the number of the nozzles 15 having a discharge failure is determined to be equal to or less than the predetermined number by the detection result of the discharge failure detection unit 46, the intensive cleaning is performed instead of the normal cleaning in the following cases. In other words, in a case where the elapsed time from the execution of the previous cleaning, which is one time before the normal cleaning scheduled to be performed this time based on the detection of a discharge failure, exceeds the predetermined time set in advance, the above-described intensive cleaning is performed instead of normal cleaning since there is a high possibility that the liquid is thickened or solidified due to drying.

Next, for example, when the cartridge-type liquid storage portion 18 is attached to and detached from the holder portion 19 and the new/old liquid storage portion 18 is exchanged, it is considered that there is a high possibility that air bubbles are mixed in the liquid inside the liquid ejecting portion 12 via the supply flow path 20. Therefore, the amount of liquid discharged from the nozzle 15 required when the cleaning performed after the exchange of the liquid storage portion 18 is increased. When such a liquid storage portion 18 is exchanged, the above-described intensive cleaning which is also called an exchange cleaning is performed.

Note that, in a case where the normal cleaning is scheduled to be performed this time and the volume of the pressure chamber at that time is, for example, a large volume in which the first chamber 31 and the second chamber communicate with each other, it takes too much time to accumulate the negative pressure in such a large volume of the pressure chamber until it reaches a desired pressure value. Therefore, in such a case, the control device 41 drives the flow path opening/closing valve driving circuit 52 to switch the first flow path opening/closing valve 35 of the communication flow path 34 from the open state to the closed state. Then, the communication between the first chamber 31 and the second chamber 32 is isolated inside the container 22, and only the first chamber 31 becomes the pressure chamber in which negative pressure is accumulated. Accordingly, it is possible to shorten the time for accumulating the negative pressure until the desired pressure value is reached since the negative pressure is accumulated in the pressure chamber having a small volume necessary and sufficient in the normal cleaning to be performed this time.

According to the above-described first embodiment, the following effects can be obtained.

(1) It is possible to perform a cleaning in which the magnitude of the negative pressure applied to the closed space is different since the magnitude of the negative pressure applied to the closed space can be changed by changing the volume of the pressure chamber.

(2) It is possible to efficiently perform a cleaning for discharging the liquid from the liquid ejecting portion 12 since the amount of liquid discharged from the liquid ejecting portion 12 via the nozzle 15 and the time for accumulating the negative pressure in the pressure chamber can be optimized by changing the volume of the pressure chamber.

(3) When the elapsed time from the execution of the previous cleaning is long enough to exceed the predetermined time, it is desirable that the negative pressure applied to the closed space is large since there is a high possibility that the liquid is thickened or solidified due to drying. In this regard, according to the present embodiment, when the elapsed time after execution of the previous cleaning exceeds the predetermined time, the negative pressure applied to the closed space can be increased by increasing the volume of the pressure chamber. Therefore, it is possible to perform a cleaning in which the magnitude of the negative pressure applied to the closed space is different in accordance with the elapsed time from the previous cleaning.

(4) When an attachable/detachable exchange of the liquid storage portion 18 is performed, the amount of liquid discharged from the nozzle 15 required for the cleaning performed after the exchange is increased due to air bubbles tend to be mixed into the flow path from the liquid storage portion 18 to the liquid ejecting portion 12. In this regard, according to the present embodiment, the amount of liquid discharged from the nozzle 15 can be increased by increasing the volume of the pressure chamber after the liquid storage portion 18 is exchanged. Therefore, it is possible to perform a cleaning in which the magnitude of the negative pressure applied to the closed space is different in accordance with the attachable/detachable exchange of the liquid storage portion 18.

(5) When the number of the nozzles 15 having a discharge failure is larger than the predetermined number, it is possible to increase the negative pressure applied to the closed space by making the volume of the pressure chamber larger than when the number of the nozzles 15 having a discharge failure is equal to or less than the predetermined number. Furthermore, when the number of the nozzles 15 having a discharge failure is equal to or less than the predetermined number, the volume of the pressure chamber may be small, so that the amount of liquid discharged from the nozzle 15 is reduced, and it is possible to reduce the waste of liquid. Therefore, it is possible to perform a cleaning in which the magnitude of the negative pressure applied to the closed space is different in accordance with the number of the nozzles 15 having a discharge failure.

(6) It is possible to achieve a recovery by applying further larger negative pressure to the closed space with respect to the nozzle 15 in which a discharge failure cannot be recovered in the previous cleaning.

(7) When the number of the operation commands is larger than the predetermined number, it can be determined that the negative pressure applied to the closed space is insufficient in the cleaning based on the previous operation command, so that it is possible to increase the negative pressure applied to the closed space by making the volume of the pressure chamber larger than when the number of the operation commands is equal to or less than the predetermined number. Therefore, it is possible to perform a cleaning in which the magnitude of the negative pressure applied to the closed space is different in accordance with the number of the operation commands.

(8) When the number of the liquid ejecting portions 12 on which the cleaning is performed is large, the magnitude of the negative pressure applied to the closed space becomes larger than when the number of the liquid ejecting portions 12 on which the cleaning is performed is small. In this regard, according to the present embodiment, even when the cleaning is performed where the number of the liquid ejecting portions 12 on which the cleaning is performed is large, it is possible to suppress a decrease in the magnitude of the negative pressure applied to the closed space since the volume of the pressure chamber can be increased. Further, when the number of the liquid ejecting portions 12 on which the cleaning is performed is small, it is possible to shorten the time taken to accumulate the negative pressure with respect to the pressure chamber since the volume of the pressure chamber may be smaller than when the number of the liquid ejecting portions 12 on which the cleaning is performed is large.

(9) The volume of the pressure chamber may be small when the number of the liquid ejecting portions 12 that need to be cleaned is small since the number of the nozzles 15 having a discharge failure is larger than the predetermined number and the volume of the pressure chamber can be changed in accordance with the number of the caps 21 corresponding to the liquid ejecting portions 12 that need to be cleaned. Therefore, it is possible to shorten the time taken to accumulate the negative pressure with respect to the pressure chamber. In addition, it is possible to suppress wasteful liquid ejection from the nozzle 15 since only the liquid ejecting portion 12 that needs to be cleaned is cleaned.

(10) As an example, the volume of the pressure chamber can be easily changed based on driving of the communication flow path opening/closing mechanism configured with at least one of the first flow path opening/closing valve 35 and the second flow path opening/closing valve 36.

Second Embodiment

Next, a second embodiment of the liquid ejecting apparatus 11 will be described.

In the second embodiment, the same reference numerals as those in the first embodiment denote the same configurations as those of the first embodiment, and the description thereof will be omitted. In the following description, differences from the first embodiment will be mainly described.

Figure 3:
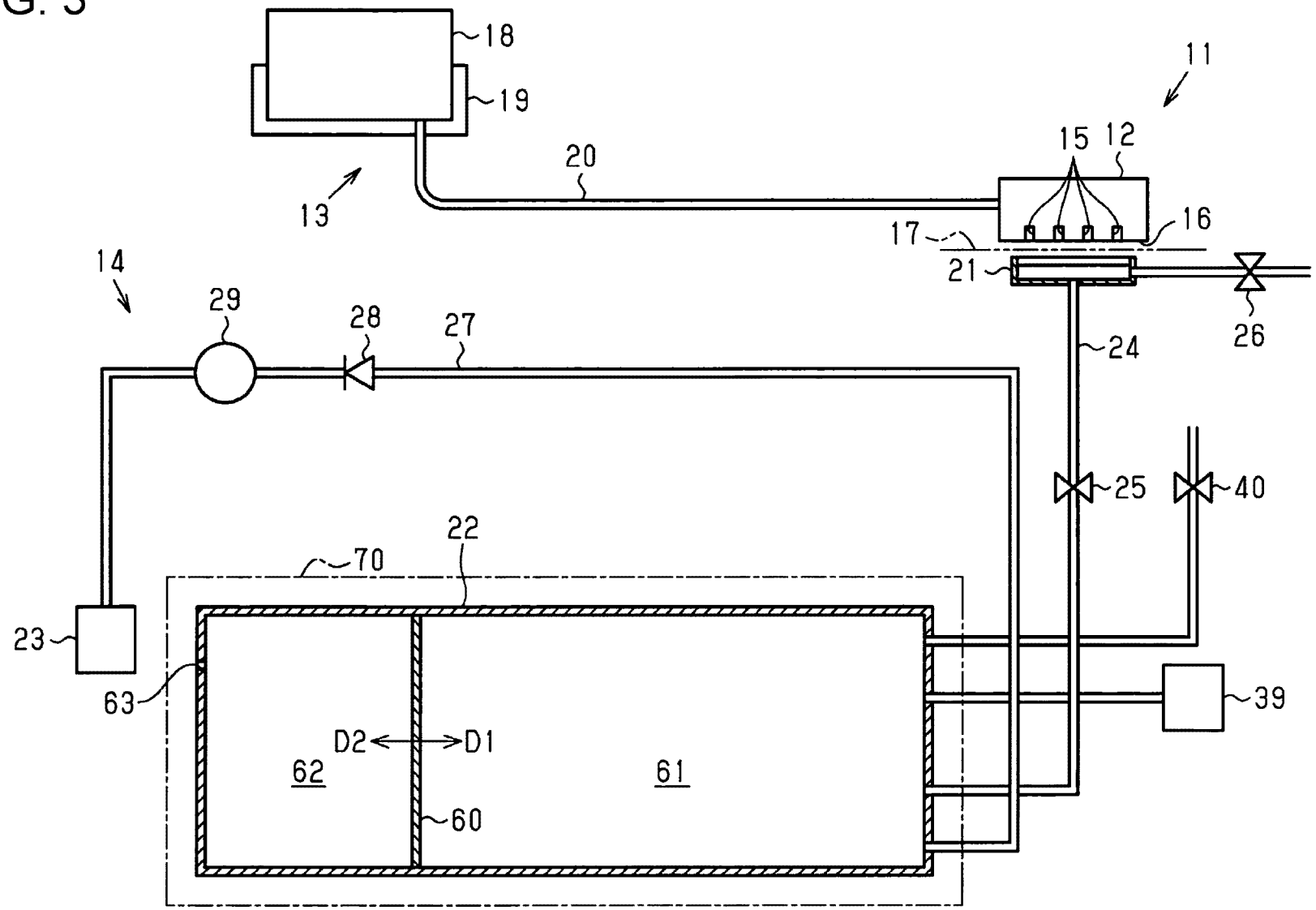
FIG. 3 is a schematic diagram schematically showing an overall configuration of a liquid ejecting apparatus according to a second embodiment.

As shown in FIG. 3, a space inside a container 22 is divided into a plurality (two in the present embodiment) of chambers 61 and 61 by a moving member 60 which is a movable partition wall provided so as to be reciprocally movable within the container 22. Among the plurality of chambers 61 and 62, the downstream end of the discharge flow path 24 and the upstream end of the recovery flow path 27 are connected to the chamber 61 positioned on the right side of the moving member 60 in FIG. 3. That is in a case where a pressure opening/closing valve 25 is opened, the chamber 61 positioned on the right side of the moving member 60 in FIG. 3 is communicated via a discharge flow path 24 with a closed space between a cap 21 that is ascended to a contact position and a liquid ejecting portion 12. A pressure sensor 39 and a release valve 40 are provided in the right side chamber 61.

On the other hand, in a part of a partition wall of the chamber 62 positioned on the left side of the moving member 60 in FIG. 3, an atmosphere opening port 63 for opening the internal space of the chamber 62 to the outside atmosphere is formed. Therefore, in either case of a state in which the right side chamber 61 communicates with the atmosphere due to opening of the release valve 40 or the like and a state of non-communication state, the moving member 60 can be moved in a first direction D1 and a second direction D2 indicated by an arrow in FIG. 3.

That is in a state in which the right side chamber 61 connected to the downstream end of a discharge flow path 24 is in communication with the atmosphere, the moving member 60 is movable in the first direction D1 for decreasing the volume of the right side chamber 61. After the movement, in a state in which the pressure opening/closing valve 25 of the discharge flow path 24 is closed and a state in which the chamber 61 on the right side is isolated from the atmosphere, the moving member 60 is movable in the second direction D2 at this time for increasing the volume of the right side chamber 61.

In this case, in the right side chamber 61 in the container 22 after the moving member 60 once moved in the first direction D1, it becomes possible to accumulate a negative pressure in the right side chamber 61 when moving in the second direction D2. Then, the negative pressure accumulated in the right side chamber 61 applied to the closed space between the cap 21 and the liquid ejecting portion 12 by opening the pressure opening/closing valve 25 of the discharge flow path 24. In this regard, in a case of the present embodiment, among the plurality of chambers 61 and 62 partitioned by the moving member 60 in the container 22, the right side chamber 61 becomes a pressure chamber in which the negative pressure is accumulated. Then, a negative pressure generation mechanism 70 and a volume variable mechanism are configured including the container 22 and the moving member 60 capable of reciprocating within the container 22. The volume variable mechanism makes it possible to change the volume of the chamber 61 functioning as a pressure chamber by moving the moving member 60 in the first direction D1 and the second direction D2.

As shown in FIG. 3, a connection portion between the right side chamber 61 and the discharge flow path 24, a connection portion between the right side chamber 61 and the recovery flow path 27, a connection portion between the right side chamber 61 and the flow path communicating with the release valve 40, and a connection portion between the right side chamber 61 and the pressure sensor 39 are provided so as not to protrude to the side wall of the right side chamber 61, in other words, to the wall portion of the right side chamber 61 on the side in the first direction D1. With such a configuration, the moving member 60 can move so that the volume of the right side chamber 61 becomes zero. Accordingly, it is possible to increase the magnitude of the negative pressure that can be accumulated in the right side chamber 61.

In the liquid ejecting apparatus 11 of the second embodiment configured as described above, the normal cleaning and the intensive cleaning described above are selectively used as in the case of the first embodiment when a maintenance device 14 performs a suction cleaning for the liquid ejecting portion 12. That is, the intensive cleaning in which the volume of the pressure chamber is increased and the negative pressure is increased is performed in the following cases. When the elapsed time from the previous cleaning is performed exceeds the predetermined time, the number of times of cleaning by the operation command by a user within the predetermined time is larger than the predetermined number of times, the number of the nozzles 15 having a discharge failure is larger than the predetermined number, the liquid storage portion 18 is exchanged, or the like. In this case, instead of opening/closing the flow path opening/closing valves 35, 36 of the communication flow path 34 communicating the plurality of chambers 31, 32, and 33 as in the first embodiment, the volume of the pressure chamber in which the negative pressure is accumulated is changed by moving the moving member 60 that defines the chamber 61 which becomes a pressure chamber in the container 22.

More specifically, the volume variable mechanism at the time of performing the intensive cleaning performs at least either one of an operation of moving the movement amount of the moving member 60 in the first direction D1 so as to be larger than that in the case of the normal cleaning in a state in which the right side chamber 61 in the container 22 is in communication with the atmosphere and an operation of moving the movement amount of the moving member 60 in the second direction D2 so as to be larger than that in the case of the normal cleaning in a state in which the right side chamber 61 in the container 22 is isolated from the atmosphere.

According to the second embodiment, in addition to the effects (1) and (2) of the first embodiment, the following effects can be obtained.

(11) The number of parts can be reduced by integrating the volume variable mechanism and the negative pressure generation mechanism 70.

Note that, the above-described embodiment may be modified as in the following modification examples. In addition, the configurations included in these embodiments and the configurations included in the following modification examples may be arbitrarily combined, or the configurations included in the following modification examples may be arbitrarily combined with each other.

Figure 4:
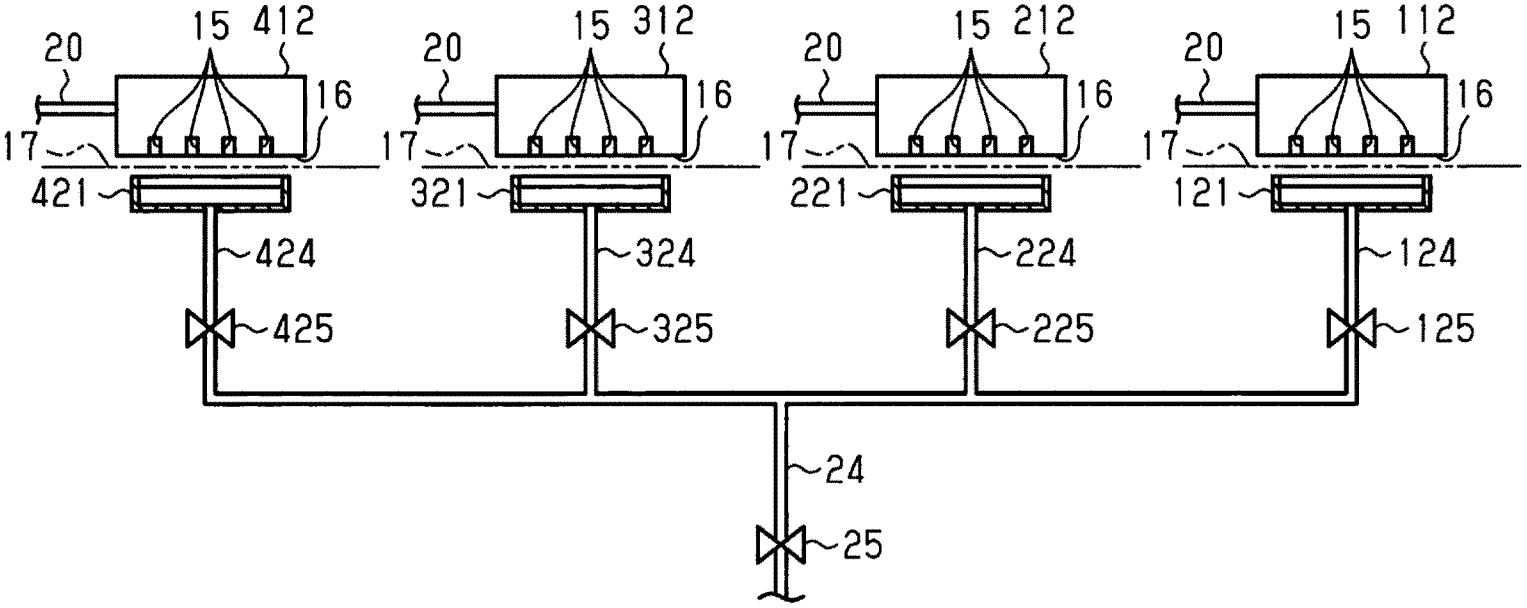
FIG. 4 is a schematic diagram schematically showing a part of a liquid ejecting apparatus according to a modification example.

As shown in FIG. 4, it may be configured to provide a plurality of liquid ejecting portions 112, 212, 312, and 412, and a plurality of caps 121, 221, 321, and 421 corresponding to the plurality of liquid ejecting portions, and include branch flow path portions 124, 224, 324, and 424 branching to be capable of communicating with the plurality of caps on the side opposite to the side communicating with the pressure chamber in the length direction of the discharge flow path 24. Branch flow path opening/closing valves 125, 225, 325, and 425 may be provided in the branch flow path portions 124, 224, 324, and 424, respectively. The branch flow path opening/closing valves 125, 225, 325, and 425 are valves capable of opening/closing the branch flow path portions 124, 224, 324, and 424, respectively. With such a configuration, only the cap corresponding to the liquid ejecting portion of a cleaning target on which the cleaning is performed can be communicated with the pressure chamber.

In a case where the cleaning is performed for a plurality of liquid ejecting portions, the volume V' of the closed space increases according to the above expression, so that the pressure P' inside the total space of the pressure chamber and the closed space becomes small. That is when the volume of the pressure chamber is the same, the magnitude of the negative pressure applied to the closed space decreases as the number of the caps increases. Therefore, when cleaning is performed for the plurality of liquid ejecting portions, for example, as described above, it is necessary to increase the volume V of the pressure chamber in order to perform a cleaning with the same intensity as the magnitude of the negative pressure applied to the closed space by the cleaning performed for one liquid ejecting portion.

In this regard, with the configuration as shown in the modification example shown in FIG. 4, the volume variable mechanism enabling the volume of the pressure chamber to be changed can change the volume of the pressure chamber in accordance with the number of the liquid ejecting portions of a cleaning target on which the cleaning is performed. In other words, when the number of the liquid ejecting portions of a cleaning target on which the cleaning is performed is large, it is possible to suppress a decrease in the magnitude of the negative pressure applied to the closed space by making the volume of the pressure chamber larger than when the number of the liquid ejecting portions of a cleaning target on which the cleaning is performed is small. Further, when the number of the liquid ejecting portions on which the cleaning is performed is small, it is possible to shorten the time taken to accumulate the negative pressure with respect to the pressure chamber since the volume of the pressure chamber may be small. In addition, each of the plurality of liquid ejecting portions, the number of the caps, the number of branches of the branch flow path portion, and the branch flow path opening/closing valves may be plural other than the four shown in FIG. 4.

In the modification example shown in FIG. 4, it may be configured that a discharge failure detection unit 46 capable of detecting a discharge failure of the nozzles 15 of the plurality of liquid ejecting portions is provided and the cleaning is performed with respect to the liquid ejecting portion in which the number of the nozzles 15 having a discharge failure is larger than the predetermined number. According to the configuration, since the number of the nozzles 15 having a discharge failure is larger than the predetermined number and the volume of the pressure chamber can be changed in accordance with the number of the liquid ejecting portions that need to be cleaned, the volume of the pressure chamber may be small when the number of the liquid ejecting portions that need to be cleaned is small. Therefore, it is possible to shorten the time taken to accumulate the negative pressure with respect to the pressure chamber. In addition, since only the liquid ejecting portion that needs to be cleaned is cleaned, it is possible to suppress wasteful liquid ejection from the nozzle 15.

In the modification example shown in FIG. 4, when cleaning is required for the plurality of liquid ejecting portions, cleaning may be performed by dividing the cleaning into a plurality of times. That is when it is necessary to perform a cleaning for a plurality of liquid ejecting portions, for example, a plurality of liquid ejecting portions such as eight, the cleaning may be performed twice by setting the liquid ejecting portions of a cleaning target on which the cleaning is performed to four by controlling the opening/closing of the branch flow path opening/closing valve. By decreasing the number of the liquid ejecting portions on which the cleaning is performed at a time, it is possible to apply the negative pressure uniformly to the closed space as compared with a case where the number of the liquid ejecting portions on which the cleaning is performed at a time is large. Further, when the number of the liquid ejecting portions on which the cleaning is performed is small by changing the volume of the pressure chamber corresponding to the number of the liquid ejecting portions of a cleaning target on which the cleaning is performed at a time, it is possible to shorten the time for accumulating the negative pressure in the pressure chamber as compared with the case where the number of the liquid ejecting portions on which the cleaning is performed is large.

The moving member 60 in the second embodiment may be configured to a member having flexibility and capable of being flexibly deformed, and may be configured to be able to change the volume of the pressure chamber by deforming the part of the area facing the right side chamber 61 functioning as a pressure chamber in the moving member 60 so as to reciprocate with deflection in the first direction D1 and the second direction D2.

In the discharge flow path 24, when at least a part of the flow path where the discharge flow path opening/closing mechanism is provided is configured to a tube having a flexibility or the like, the discharge flow path opening/closing mechanism capable of opening/closing the discharge flow path 24 may be configured to a clip member that sandwiches or opens the part of the flow path having a flexibility.

In the communication flow path 34, when at least a part of the flow path where the communication flow path opening/closing mechanism is provided is configured to a tube having a flexibility or the like, the communication flow path opening/closing mechanism capable of opening/closing the communication flow path 34 may be configured to a clip member that sandwiches or opens the part of the flow path having a flexibility.

In the first embodiment, the number of the chambers 31, 32, and 33 partitioned by the partition walls 30 in the container 22 may be a plurality of numbers other than three. The pressure chamber may be configured that a plurality of pressure chambers individually provided in each of the plurality of containers 22 are communicated with each other or blocked, other than being partitioned into a plurality of chambers by the partition walls 30 in one container 22.

In the first embodiment, the communication flow path 34 may be configured with a first communication flow path that allows the first chamber 31 and the second chamber 32 communicate each other, and a second communication flow path that allows the first chamber 31 and the third chamber 33 communicate each other. Also in the communication flow path 34, the first flow path opening/closing valve 35 may be provided in the first communication flow path and the second flow path opening/closing valve 36 may be provided in the second communication flow path.

A cleaning, in which the negative pressure is accumulated in the pressure chamber by driving the negative pressure generation mechanism 37 and the negative pressure generation mechanism 37 is continuously driven even after opening the pressure opening/closing valve 25 in order to apply the negative pressure to the closed space, may be performed. With such a configuration, it is possible to maintain a state where the negative pressure applied to the closed space is large for a long time as compared with a case where the negative pressure generation mechanism 37 is not driven after the pressure opening/closing valve 25 is opened.

When the nozzle 15 having a discharge failure is detected again after executing the intensive cleaning based on the result that the discharge failure detection unit 46 detected the number of the nozzles 15 having a discharge failure more than the predetermined number, a negative pressure accumulated in the pressure chamber having the same volume as that of the previous intensive cleaning may be applied to the closed space and the intensive cleaning may be performed again without further increasing the volume of the pressure chamber.

The suction cleaning performed immediately after the attachable/detachable exchange of the liquid storage portion 18 may be the normal cleaning in which the volume of the pressure chamber is the same as usual, instead of the intensive cleaning in which the volume of the pressure chamber is increased.

A threshold value for determining whether or not the elapsed time since the execution of the previous cleaning has exceeded the predetermined time can be set to any value.

When a range in which the suction pump 29 is pressed by a rollers in a tube disposed along the inner wall surface of a pump case is 360 degrees or more and the arrangement shape of the tube is a so-called a character shape tube pump formed into a spiral shape, the check valve 28 on the upstream side from the suction pump 29 of the recovery flow path 27 may be omitted as the tube pump functions as a one-way valve.

The idea of the cleaning in which the negative pressure accumulated in the pressure chamber is changed by changing the volume of the pressure chamber and the changed negative pressure is applied to the closed space can be applied to so-called flushing in which a liquid is discharged by driving a piezoelectric element based on command information irrelevant to printing from the liquid ejecting portion 12. That is the liquid discharged into the cap 21 by the flushing may be sucked by using the negative pressure accumulated in the pressure chamber.

According to the configuration, suction performance improves since the suction force due to the negative pressure is applied and the flow rate becomes fast as compared with a case where the liquid is sucked from the cap 21 by suction driving of the suction pump 29. It is preferable to reduce the driving time of the negative pressure generation mechanism for accumulating the negative pressure by reducing the volume of the pressure chamber, since the amount of liquid discharged into the cap 21 by the flushing is smaller than the amount of liquid discharged from the nozzle 15 by the cleaning.

When the liquid ejecting apparatus 11 of the embodiment is used in a low altitude high land or the like, the time for accumulating the negative pressure to the target relative pressure can be shortened by reducing the volume of the pressure chamber.

In the liquid ejecting apparatus 11 may be a so-called line head printer in which a liquid ejecting portion 12 having a group of nozzles 15 covering the entire width direction intersecting the transport direction of a medium 17 is fixedly disposed and printing is performed by ejecting a liquid from the group of the nozzles 15 of the liquid ejecting portion 12 to the medium 17 transported at a position facing the opening surface 16 of the liquid ejecting portion 12.

Technical ideas and the working effects grasped from the above-described embodiments and modifications are described below.

Idea 1

A liquid ejecting apparatus including: a liquid ejecting portion configured to eject a liquid from a nozzle; a cap configured to be relatively move with respect to the liquid ejecting portion and configured to form a closed space in which the nozzle is open between the cap and the liquid ejecting portion; a negative pressure generation mechanism configured to generate a negative pressure; a pressure chamber configured to accumulate the negative pressure by driving the negative pressure generation mechanism; a discharge flow path that communicates with the cap and the pressure chamber; a discharge flow path opening/closing mechanism configured to open and close the discharge flow path; a volume variable mechanism configured to change a volume of the pressure chamber; and a controller that controls the negative pressure generation mechanism, the discharge flow path opening/closing mechanism, and the volume variable mechanism.

According to the configuration, it is possible to perform a cleaning in which the magnitude of the negative pressure applied to the closed space is different since the magnitude of the negative pressure applied to the closed space can be changed by changing the volume of the pressure chamber.

Idea 2

The liquid ejecting apparatus according to "Idea 1", in which the controller drives the negative pressure generation mechanism to accumulate the negative pressure in the pressure chamber in a state that the discharge flow path is closed, then by opening the discharge flow path, the negative pressure accumulated in the pressure chamber is applied to the closed space to perform a cleaning that the liquid is discharged from the nozzle.

According to the configuration, it is possible to efficiently perform a cleaning in which the liquid is discharged from the liquid ejecting portion since the amount of the liquid discharged from the liquid ejecting portion via the nozzle and the time for accumulating the negative pressure in the pressure chamber can be optimized by changing the volume of the pressure chamber.

Idea 3

The liquid ejecting apparatus according to "Idea 2", further including: a measurement unit measuring an elapsed time from a performance of the cleaning last time, in which when the elapsed time measured by the measurement unit exceeds a predetermined time, the controller controls the volume variable mechanism so as to make the volume of the pressure chamber larger than the volume of the pressure chamber when the elapsed time does not exceed the predetermined time, and then performs the cleaning.

When the elapsed time from the performance of the previous cleaning is long enough to exceed the predetermined time, it is desirable that the negative pressure applied to the closed space is large since there is a high possibility that the liquid is thickened or solidified due to drying. In this regard, according to the above-described configuration, when the elapsed time after the performance of the previous cleaning exceeds the predetermined time, the negative pressure applied to the closed space can be increased by increasing the volume of the pressure chamber. Therefore, it is possible to perform a cleaning in which the magnitude of the negative pressure applied to the closed space is different in accordance with the elapsed time from the previous cleaning.

Idea 4

The liquid ejecting apparatus according to "Idea 2 or 3", further including: a liquid storage portion configured to be attached to the liquid ejecting apparatus in an attachable/detachable manner and stored a liquid to be supplied to the liquid ejecting portion, in which when an exchange of the liquid storage portion is performed, the controller controls the volume variable mechanism so as to make the volume of the pressure chamber larger than the volume of the pressure chamber before the exchange of the liquid storage portion is performed, and then performs the cleaning.

When the attachable/detachable exchange of the liquid storage portion is performed, the amount of liquid discharged from the nozzle required for the cleaning performed after the exchange is increased due to air bubbles tend to be mixed into the flow path from the liquid storage portion to the liquid ejecting portion. In this regard, according to the above-described configuration, the amount of liquid discharged from the nozzle can be increased by increasing the volume of the pressure chamber after the liquid storage portion is exchanged. Therefore, it is possible to perform a cleaning in which the magnitude of the negative pressure applied to the closed space is different in accordance with the attachable/detachable exchange of the liquid storage portion.

Idea 5

The liquid ejecting apparatus according to "any one of Ideas 2 to 4", further including: a discharge failure detection unit that detects a discharge failure of the nozzle, in which when the number of the nozzles having a discharge failure detected by the discharge failure detection unit is larger than a predetermined number, the controller controls the volume variable mechanism so as to make the volume of the pressure chamber larger than the volume of the pressure chamber when the number of the nozzles having a discharge failure is equal to or less than the predetermined number, and then performs the cleaning.

According to the configuration, when the number of the nozzles having a discharge failure is larger than the predetermined number, it is possible to increase the negative pressure applied to the closed space by making the volume of the pressure chamber larger than the volume of the pressure chamber when the number of the nozzles having a discharge failure is equal to or less than the predetermined number. Furthermore, when the number of the nozzles having a discharge failure is equal to or less than the predetermined number, the volume of the pressure chamber may be small, so that the amount of liquid discharged from the nozzle is reduced, and it is possible to reduce the waste of liquid. Therefore, it is possible to perform a cleaning in which the magnitude of the negative pressure applied to the closed space is different in accordance with the number of the nozzles having a discharge failure.

Idea 6

The liquid ejecting apparatus according to "Idea 5", in which when a discharge failure of the nozzle is detected by the discharge failure detection unit after the cleaning is performed by changing the volume of the pressure chamber in accordance with the number of the nozzles having a discharge failure detected by the discharge failure detection unit, the controller controls the volume variable mechanism so as to make the volume of the pressure chamber larger than the volume of the pressure chamber when the cleaning last time is performed, and then performs the cleaning.

According to the configuration, it is possible to achieve a recovery by applying further larger negative pressure to the closed space with respect to the nozzle in which a discharge failure cannot be recovered in the previous cleaning.

Idea 7

The liquid ejecting apparatus according to "any one of Ideas 2 to 6", in which when the number of times of an operation command of the cleaning performed based on the operation command from an outside is larger than predetermined number of times, the controller controls the volume variable mechanism so as to make the volume of the pressure chamber larger than the volume of the pressure chamber when the number of times of the operation command of the cleaning is equal to or less than the predetermined number of times, and then performs the cleaning.

According to the configuration, when the number of the operation commands is larger than the predetermined number, it can be determined that the negative pressure applied to the closed space is insufficient in the cleaning based on the previous operation command, so that it is possible to increase the negative pressure applied to the closed space by making the volume of the pressure chamber larger than the volume of the pressure chamber when the number of the operation commands is equal to or less than the predetermined number. Therefore, it is possible to perform a cleaning different in the magnitude of the negative pressure applied to the closed space according to the number of the operation commands.

Idea 8

The liquid ejecting apparatus according to "Idea 2", in which a plurality of the liquid ejecting portions are provided, in which a plurality of the caps are provided respectively corresponding to the plurality of the liquid ejecting portions, and closed spaces corresponding to each of the plurality of the liquid ejecting portions can be formed, in which the discharge flow path has a branch flow path portion that branches so as to communicate with the plurality of the caps, and in which when the number of the caps corresponding to the liquid ejecting portions of a cleaning target on which the cleaning is performed is larger than a prescribed number, the controller controls the volume variable mechanism so as to make the volume of the pressure chamber larger than the volume of the pressure chamber when the number of the caps corresponding to the liquid ejecting portions of a cleaning target on which the cleaning is performed is equal to or less than the prescribed number, and then performs the cleaning.

When the number of the liquid ejecting portions on which the cleaning is performed is larger than the prescribed number, the magnitude of the negative pressure applied to the closed space becomes larger than the magnitude of the negative pressure applied to the closed space when the number of the liquid ejecting portions on which the cleaning is performed is equal to or less than the prescribed number. In this regard, according to the above-described configuration, even when the cleaning is performed where the number of the liquid ejecting portions on which the cleaning is performed is larger than the prescribed number, it is possible to suppress a decrease in the magnitude of the negative pressure applied to the closed space since the volume of the pressure chamber can be increased. Further, when the number of the liquid ejecting portions on which the cleaning is performed is equal to or less than the prescribed number, it is possible to shorten the time taken to accumulate the negative pressure with respect to the pressure chamber since the volume of the pressure chamber may be smaller than the volume of the pressure chamber when the number of the liquid ejecting portions on which the cleaning is performed is larger than the prescribed number.

Idea 9

The liquid ejecting apparatus according to "Idea 8", further including: a discharge failure detection unit that detects a discharge failure of the nozzles of the plurality of the liquid ejecting portions, in which the controller performs the cleaning for the caps corresponding to the liquid ejecting portions in which the number of the nozzles having a discharge failure detected by the discharge failure detection unit is larger than a predetermined number.

According to the configuration, the volume of the pressure chamber may be small when the number of the liquid ejecting portions that need to be cleaned is small since the number of the nozzles having a discharge failure is larger than the predetermined number and the volume of the pressure chamber can be changed in accordance with the number of the caps corresponding to the liquid ejecting portions that need to be cleaned. Therefore, it is possible to shorten the time taken to accumulate the negative pressure with respect to the pressure chamber. In addition, it is possible to suppress wasteful liquid ejection from the nozzle since only the liquid ejecting portion that needs to be cleaned is cleaned.

Idea 10

The liquid ejecting apparatus according to "any one of Ideas 1 to 9", in which the pressure chamber is configured to include one chamber communicated with the discharge flow path and at least one other chamber communicable with the one chamber via a communication flow path, and the volume variable mechanism is configured to be provided in the middle of the communication flow path and include a communication flow path opening/closing mechanism configured to open and close the communication flow path.

According to this configuration, the volume of the pressure chamber can be easily changed based on driving of the communication flow path opening/closing mechanism.

Idea 11

The liquid ejecting apparatus according to "Idea 1", in which the negative pressure generation mechanism and the volume variable mechanism are configured to include a common container and a common moving member capable of reciprocating within the container, in which the pressure chamber is partitioned into the container by the moving member and communicates with the closed space via the discharge flow path, in which the volume variable mechanism makes the volume of the pressure chamber changeable by moving the moving member, and in which the controller causes the volume variable mechanism to move the moving member in a direction to decrease the volume of the pressure chamber in a state where the pressure chamber communicates with the atmosphere, then causes the volume variable mechanism to move the moving member in a direction to increase the volume of the pressure chamber so as to accumulate the negative pressure in the pressure chamber in a state in which the discharge flow path is closed and the pressure chamber is isolated from the atmosphere, after that, by opening the discharge flow path, the negative pressure accumulated in the pressure chamber is applied to the closed space to perform a cleaning in which the liquid is discharged from the nozzle.

According to this configuration, the same effects as Ideas 1 and 2 can be obtained while reducing the number of the parts by integrating the volume variable mechanism and the negative pressure generation mechanism.

The entire disclosure of Japanese Patent Application No. 2018-052139, filed Mar. 20, 2018 is expressly incorporated by reference herein.

What is claimed is:

1. A liquid ejecting apparatus comprising:

a liquid ejecting portion configured to eject a liquid from a nozzle;

a cap configured to be relatively move with respect to the liquid ejecting portion and configured to form a closed space in which the nozzle is open between the cap and the liquid ejecting portion;

a negative pressure generation mechanism configured to generate a negative pressure;

a pressure chamber configured to accumulate the negative pressure by driving the negative pressure generation mechanism;

a discharge flow path that communicates with the cap and the pressure chamber;

a discharge flow path opening/closing mechanism configured to open and close the discharge flow path;

a volume variable mechanism configured to change a volume of the pressure chamber and keep the changed volume both when the negative pressure is accumulated and when the negative pressure is released; and a controller that controls the negative pressure generation mechanism, the discharge flow path opening/closing mechanism, and the volume variable mechanism.

2. The liquid ejecting apparatus according to claim 1, wherein the controller drives the negative pressure generation mechanism to accumulate the negative pressure in the pressure chamber in a state that the discharge flow path is closed, then by opening the discharge flow path, the negative pressure accumulated in the pressure chamber is applied to the closed space to perform a cleaning that the liquid is discharged from the nozzle.

3. The liquid ejecting apparatus according to claim 2, further comprising:

a measurement unit measuring an elapsed time from a performance of the cleaning last time, wherein when the elapsed time measured by the measurement unit exceeds a predetermined time, the controller controls the volume variable mechanism so as to make the volume of the pressure chamber larger than the volume of the pressure chamber when the elapsed time does not exceed the predetermined time, and then performs the cleaning.

4. The liquid ejecting apparatus according to claim 2, further comprising:

a liquid storage portion configured to be attached to the liquid ejecting apparatus in an attachable/detachable manner and stored a liquid to be supplied to the liquid ejecting portion, wherein when an exchange of the liquid storage portion is performed, the controller controls the volume variable mechanism so as to make the volume of the pressure chamber larger than the volume of the pressure chamber before the exchange of the liquid storage portion is performed, and then performs the cleaning.

5. The liquid ejecting apparatus according to claim 2, further comprising:

a discharge failure detection unit that detects a discharge failure of the nozzle, wherein when the number of the nozzles having the discharge failure detected by the discharge failure detection unit is larger than a predetermined number, the controller controls the volume variable mechanism so as to make the volume of the pressure chamber larger than the volume of the pressure chamber when the number of the nozzles having the discharge failure is equal to or less than the predetermined number, and then performs the cleaning.

6. The liquid ejecting apparatus according to claim 5, wherein when the discharge failure of the nozzle is detected by the discharge failure detection unit after the cleaning is performed by changing the volume of the pressure chamber in accordance with the number of the nozzles having the discharge failure detected by the discharge failure detection unit, the controller controls the volume variable mechanism so as to make the volume of the pressure chamber larger than the volume of the pressure chamber when the cleaning last time is performed, and then performs the cleaning.

7. The liquid ejecting apparatus according to claim 2, wherein when the number of times of an operation command of the cleaning performed based on the operation command from an outside is larger than predetermined number of times, the controller controls the volume variable mechanism so as to make the volume of the pressure chamber larger than the volume of the pressure chamber when the number of times of the operation command of the cleaning is equal to or less than the predetermined number of times, and then performs the cleaning.

8. The liquid ejecting apparatus according to claim 2, wherein a plurality of the liquid ejecting portions are provided, wherein a plurality of the caps are provided respectively corresponding to the plurality of the liquid ejecting portions, and closed spaces respectively corresponding to the plurality of liquid ejecting portions can be formed, wherein the discharge flow path has a branch flow path portion that branches so as to communicate with the plurality of caps, and wherein when the number of the caps corresponding to the liquid ejecting portions of a cleaning target on which the cleaning is performed is larger than a prescribed number, the controller controls the volume variable mechanism so as to make the volume of the pressure chamber larger than the volume of the pressure chamber when the number of the caps corresponding to the liquid ejecting portions of the cleaning target on which the cleaning is performed is equal to or less than the prescribed number, and then performs the cleaning.

9. The liquid ejecting apparatus according to claim 8, further comprising:

a discharge failure detection unit that detects a discharge failure of the nozzles of the plurality of liquid ejecting portions, wherein the controller performs the cleaning for the caps corresponding to the liquid ejecting portions in which the number of the nozzles having the discharge failure detected by the discharge failure detection unit is larger than a predetermined number.

10. The liquid ejecting apparatus according to claim 1, wherein the pressure chamber includes one chamber communicated with the discharge flow path and at least one other chamber configured to communicate with the one chamber via a communication flow path, and wherein the volume variable mechanism includes a communication flow path opening/closing mechanism configured to open and close the communication flow path.

11. A liquid ejecting apparatus comprising:

a liquid ejecting portion configured to eject a liquid from a nozzle;

a cap configured to be relatively moved with respect to the liquid ejecting portion and configured to form a closed space in which the nozzle is open between the cap and the liquid ejecting portion;

a negative pressure generation mechanism configured to generate a negative pressure;

a pressure chamber configured to accumulate the negative pressure by driving the negative pressure generation mechanism;

a discharge flow path that communicates with the cap and the pressure chamber;

a discharge flow path opening/closing mechanism configured to open and close the discharge flow path;

a volume variable mechanism configured to change a volume of the pressure chamber;

a pressure sensor for determining the pressure in the pressure chamber; and a controller that controls the negative pressure generation mechanism, the discharge flow path opening/closing mechanism, and the volume variable mechanism, wherein the controller drives the negative pressure generation mechanism to accumulate the negative pressure in the pressure chamber in a state that the discharge flow path is closed, then by opening the discharge flow path, the negative pressure accumulated in the pressure chamber is applied to the closed space to perform a cleaning that the liquid is discharged from the nozzle, wherein the controller drives the negative pressure generation mechanism until the pressure sensor detects that the pressure in the pressure chamber has reached a predetermined threshold value.

12. The liquid ejecting apparatus according to claim 11, wherein the negative pressure generation mechanism and the volume variable mechanism include a common container and a common moving member configured to reciprocate within the container, wherein the pressure chamber is partitioned into the container by the moving member and communicates with the closed space via the discharge flow path, wherein the volume variable mechanism makes the volume of the pressure chamber changeable by moving the moving member, and wherein the controller causes the volume variable mechanism to move the moving member in a direction to decrease the volume of the pressure chamber in a state where the pressure chamber communicates with the atmosphere, then causes the volume variable mechanism to move the moving member in a direction to increase the volume of the pressure chamber so as to accumulate the negative pressure in the pressure chamber in a state that the discharge flow path is closed and in a state that the pressure chamber is isolated from the atmosphere, and then, by opening the discharge flow path, the negative pressure accumulated in the pressure chamber is applied to the closed space to perform a cleaning in which the liquid is discharged from the nozzle.

13. A liquid ejecting apparatus comprising:

a liquid ejecting portion configured to eject a liquid from a nozzle;

a cap configured to be relatively moved with respect to the liquid ejecting portion and configured to form a closed space in which the nozzle is open between the cap and the liquid ejecting portion;

a negative pressure generation mechanism configured to generate a negative pressure;

a pressure chamber configured to accumulate the negative pressure by driving the negative pressure generation mechanism;

a discharge flow path that communicates with the cap and the pressure chamber;

a discharge flow path opening/closing mechanism configured to open and close the discharge flow path;

a volume variable mechanism configured to change a volume of the pressure chamber; and a controller that controls the negative pressure generation mechanism, the discharge flow path opening/closing mechanism, and the volume variable mechanism, wherein the pressure chamber includes one chamber communicated with the discharge flow path and at least one other chamber configured to communicate with the one chamber via a communication flow path, and wherein the volume variable mechanism includes a communication flow path opening/closing mechanism configured to open and close the communication flow path.

* * * * *